United States Patent [19]

Ferraro et al.

[11] 4,213,240

[45] Jul. 22, 1980

[54] LADIES' RAZOR SYSTEM

[75] Inventors: Frank A. Ferraro, Trumbull; Ernest F. Kiraly, Fairfield, both of Conn.

[73] Assignee: Warner-Lambert Company, Morris Plains, N.J.

[21] Appl. No.: 953,306

[22] Filed: Oct. 20, 1978

Related U.S. Application Data

[63] Continuation of Ser. No. 787,657, Apr. 14, 1977, abandoned.

[51] Int. Cl.[2] ..... B24B 21/22; B24B 21/14; B24B 21/52

[52] U.S. Cl. ..... 30/47; 30/85

[58] Field of Search ..... 30/47, 50, 85

[56] References Cited

U.S. PATENT DOCUMENTS

| | | | |
|---|---|---|---|
| 3,771,223 | 11/1973 | Dawidowicz | 30/50 X |
| 3,832,774 | 9/1974 | Perry | 30/50 X |
| 3,934,338 | 1/1976 | Braginetz | 30/50 X |

*Primary Examiner*—Gary L. Smith

*Attorney, Agent, or Firm*—Jeremiah J. Duggan; Stephen A. Schneeberger

[57] ABSTRACT

A replaceable blade cartridge shaving system having an elongate handle with a coupling head formed at its terminal end. The coupling head is arrayed transversely of the handle axis and has two elongate substantially parallel coupling flanges formed thereon. The flanges extend transversely of the head and perpendicular thereto. Located between the flanges and extending a predetermined distance from the terminal end of the handle above a plane containing the flanges is a protuberance member. The cartridge has complementary grooves formed along its base for slidable engagement with the handle flanges and a recess is formed between the grooves having sufficient clearance as to allow the protuberance member to fit therein. Attempted use of the handle with other than a cartridge having such recess produces interference between the handle and the cartridge, thereby preventing slidable engagement therebetween.

9 Claims, 10 Drawing Figures

LADIES' RAZOR SYSTEM

This is a continuation of application Ser. No. 787,657, filed Apr. 14, 1977, now abandoned.

BACKGROUND OF THE INVENTION

This invention has application to a ladies' razor system. The purpose of the invention is to avoid unnecessary nicks, cuts, and scrapes due to accidental usage of incompatible shaving systems.

It is recognized that women, in comparison to men, have different shaving problems. For example, the wet shave systems normally designed for men are not adequate, or well-developed, for the underarms and legs.

The great majority of shaving systems currently on the market are directed to the needs of the male population. Of these male-oriented systems, most are of the twin blade single edge cartridge variety. U.S. Pat. No. 3,832,774, incorporated herein by reference, describes such a system comprising a cartridge having tandem assembled blades, each blade having a shaving geometry substantially the same as a single blade system. The cartridge is detachably affixed to a handle by slidable flange coupling members well known in the mechanical engineering field for ease of cartridge replacement.

Pending U.S. patent application Ser. No. 732,567, filed Oct. 15, 1976, incorporated herein by reference, describes a shaving cartridge principally directed toward the needs of women. The cartridge permits smoother, safer and more efficient shaving due to a specially adapted shape and geometry. The peculiar design of this cartridge does, however, engender a manner of usage different than its male-oriented counterpart. This difference in use has a tendency to cause increased shaving discomfort and less safety if the user were to switch back to a male-type cartridge.

An important marketing requirement of a shaving cartridge is to be useful with handles that are available. Hence, in designing the ladies' cartridge, it was essential that it should couple with existing handles, yet in observance of the problem associated with switching between female and male-oriented systems, its handle should not couple with male-oriented cartridges.

It is thus an object of the present invention to provide an arrangement comprised of a ladies' razor handle and cartridge loading mechanism which will overcome the aforesaid dangerous condition while assuring optimum enjoyment of the benefits intended by the system's unique design criteria. It is further an object of the invention to provide a blade cartridge which may be used with handles associated with other shaving systems less demanding than the ladies' system herein described but a handle that will only couple with the ladies' cartridge.

SUMMARY OF THE INVENTION

In meeting the foregoing objects and providing the desired advantages, the present invention contemplates a replaceable blade cartridge shaving system wherein a handle member is designed for exclusive use with a cartridge of special design while such cartridge may find use with other conventional handles. The handle member has an elongated grip portion connecting to a substantially transverse head portion. The head portion includes a pair of opposed flange members extending substantially perpendicular to the head portion and a protuberance located between the flanges and extending a predetermined significant distance beyond a plane containing the flanges. The replaceable blade cartridge has coupling structure defining two spaced coupling grooves adapted to receive the flanges for attaching the cartridge to the handle in a desired shaving position, and a clearance recess formed between the coupling grooves having sufficient dimension to encompass the protuberance when the cartridge is coupled to the handle.

Other objects and advantages will become readily apparent from a study of the following detailed description of the appended drawings.

DESCRIPTION OF THE PREFERRED EMBODIMENT

Figure 1:
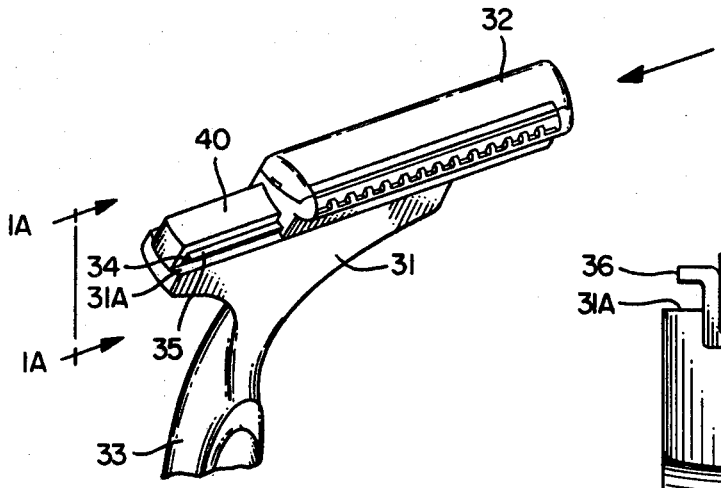
FIG. 1 is a perspective view of the preferred ladies' razor system according to this invention.
Figure 2:
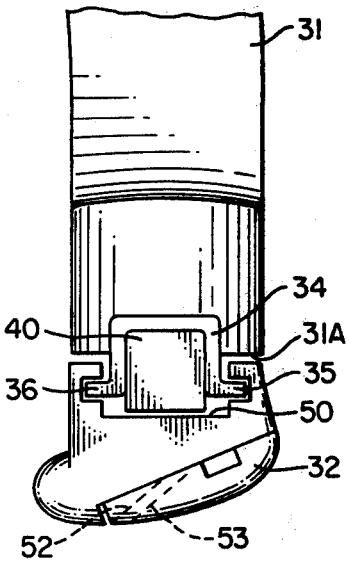
FIG. 2 is a side elevation of a portion of the system of FIG. 1.

FIGS. 1 and 2 show a razor system consisting of handle 33 terminating in head 31 arranged to releasably support cartridge 32. Elongate face 31A of head 31 is grooved to receive channel member 34 of complementary shape. Channel member 34 is generally "U" shaped with opposed edges or flanges 35 and 36 extending outwardly at substantially right angles from the upstanding side walls. Edges 35 and 36 are arranged to be received in complementary opening opposed grooves of cartridge 32. Bar member 40 located internally of channel member 34 extends vertically a significant distance beyond the limits of edges 35 and 36 to form a longitudinal protuberance arranged to be encompassed within a complementary slot or channel 50 of cartridge 32. The bar member 40 extends longitudinally substantially the full extent of head 31 of handle 33, and the complementary slot 50 similarly extends the full longitudinal extent of cartridge 32 from one end to the other to accept bar 40 when slid thereinto with a relative motion transversely of the handle 33 and longitudinally of the head 31 and cartridge 32. It will be appreciated that the geometry of slot 50 transversely of its longitudinal extent is sufficient to pass or clear the geometry of bar 40 transversely of its longitudinal extent such that cartridge 32 may be end-loaded on head 31 and slid to its desired shave position centered thereon. Cartridge 32 has a pair of parallel blades 52 and 53 placed at desired angle for shaving comfort.

With all other known cartridge shaving systems the clearance between the slide coupling channels and a surface corresponding to surface 50 of the cartridge of this invention is insufficient to accept protuberance 40 and hence handle 33. This prevents inadvertent use of a male-oriented shaving cartridge with handle 33. On the other hand, cartridge 32 is compatible with all handles intended for cartridges of a similar type.

Figure 3:
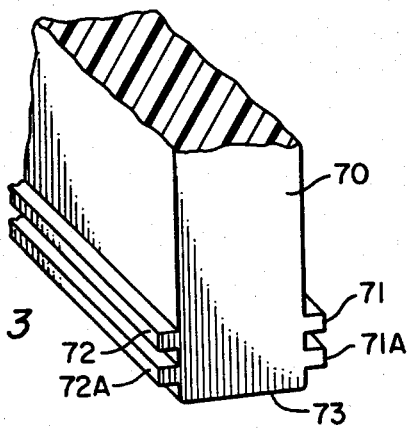
FIG. 3 is a fragmentary perspective view of an alternative head of a razor system using the concepts of this invention.
Figure 4:
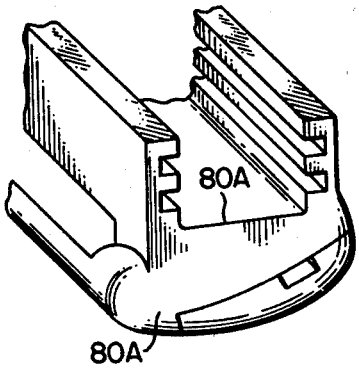
FIG. 4 is a fragmentary perspective view of a cartridge used with the razor head of FIG. 3.

In FIG. 3, there is shown an alternative shaving system construction. Head 70 has a plurality of extending perpendicularly opposed flanges 71, 71A, 72 and 72A. Normal to pairs of flanges 71 and 71A, and 72 and 72A, is an extension of the head 70, forming protuberance 73. Protuberance 73 in combination with flanges 71 and 71A and 72 and 72A cooperate and mate with central depression 80A of FIG. 4 and complementary said grooves, respectively, in the cartridge 80.

Figure 5:
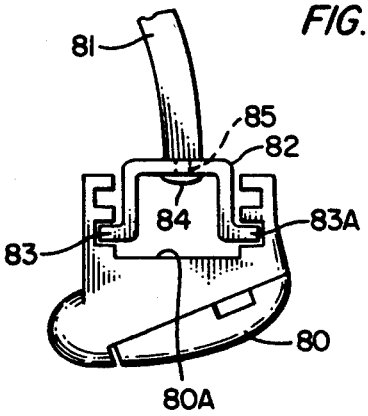
FIG. 5 is a partial side view of the cartridge of FIG. 4, mounted on a conventional handle.

FIG. 5 shows cartridge 80 mounted on a shaving system handle typical of that now extant, comprised of a handle 81 terminating in "U" channel 82, fastened to the handle 81 by upset post 84 which extends through complementary opening 85 in channel 82. Channel 82 has outwardly extending flanges 83 and 83A which seat in the innermost of the grooves formed in cartridge 80. Note central depression 80A is non-functional when used with such conventional handle.

Figure 6:
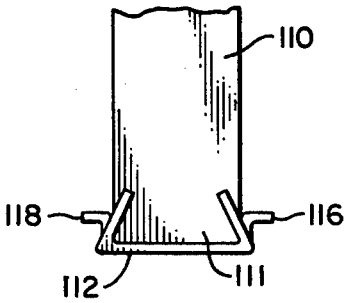
FIG. 6 is a partial elevation of an alternate head construction.
Figure 8:
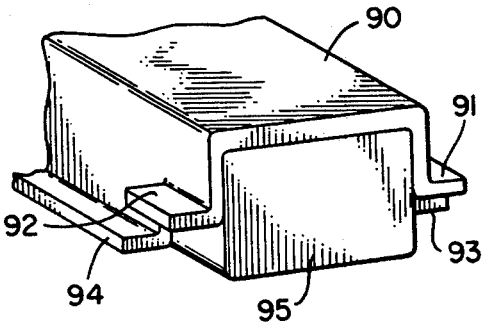
FIG. 8 is yet another alternative construction.
Figure 7:
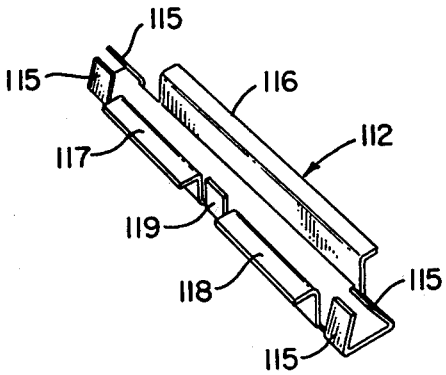
FIG. 7 is a perspective view of a channel used with the head of FIG. 6.
Figure 9:
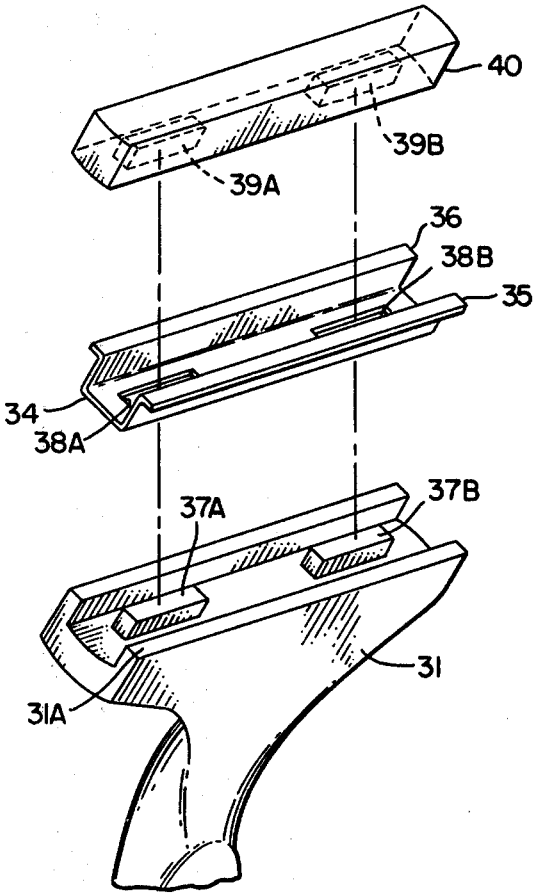
FIG. 9 is an exploded perspective view of a portion of the system of FIG. 1.

Other constructions according to this invention are shown in FIGS. 6, 7, and 8. In FIG. 8, there is shown channel 90 having adjacent one end segmented or partial extending flanges 91 and 92. Flanges 91 and 92 preferably fall in a common plane and may be at one or both ends of channel 90. In addition to fingers 91 and 92, there are outwardly extending flanges 93 and 94. Central of channel 90 is protuberance 95 which extends beyond channel 90 to mate in depression 80A of FIG. 5. As is apparent, the combination of flanges 93 and 94 and 91 and 92 can be encompassed within the geometrically complementary grooves in cartridge 80 and are analogous to flanges 71, 71A, 72 and 72A of FIG. 3.

In FIG. 6 is shown yet another design for the head of a razor handle. Head 110 terminates in a protuberance 111 which is generally trapezoid shaped in cross-section with the larger parallel face at the terminal end. Mounted thereover is substantially complementary metal channel 112. Channel 112 is better seen in FIG. 7 as it appears before mounting on the head 110 (FIG. 6). It consists of longitudinal channel 12 having outwardly extending bendable tabs 115 at each side of each end thereof. Tabs 115 are pressed onto, or about, the complementary surfaces of protuberance 111. Intermediate tabs 115 are normally outwardly extending flange members 116, 117 and 118. Flanges 116, 117 and 118 seat in geometrically complementary grooves of a suitable cartridge such as cartridge 32 of FIGS. 1 and 2. Detent 119 formed centrally of the channel 112 serves to center the blade cartridge on the end of the head 110 by contacting a complementary key in the cartridge. A similar detent may be included in all other handle and cartridge configurations shown.

Figure 1A:
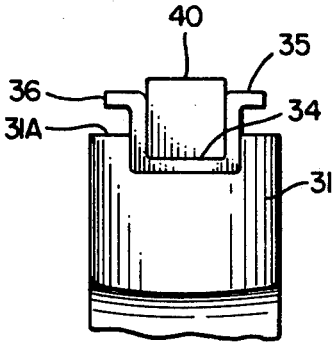
FIG. 1A is a section along the line 1A—1A of FIG. 1.

Should attempt be made to use the coupling structure of the handles shown in FIGS. 3, 4, 5 and 8, the upper coupling flange members as well as the handle protuberance will interfere with structure on conventional cartridges, thereby negating such attempt. This prevents the unwary user from inadvertently switching from the cartridge of this invention to a male-oriented cartridge with attendant untoward results. Conversely, the cartridge of FIG. 4 will find application with conventional handles as shown in FIG. 5. This permits the user to take advantage of handles that are extant in the market and therefore readily available in making use of a cartridge designed to provide advantages to the female user. The handle of FIGS. 1 and 1A as well as FIGS. 6 and 7 provide the same functional options and safeguards but achieve this by use of only the protuberance member extending from the terminal end of the handle.

The preferred method of assembling the coupling structure to the head portion of the handle involves placing "U" shaped metal channel 34 in a complementary groove of head portion 31 with a pair of posts 37A, 37B extending perpendicular to handle 33 passing through a respective complementary pair of apertures 38A, 38B in channel 34. Interference protuberance 40 having a respective complementary pair of post-receiving recesses 39A, 39B in the undersurface is then placed within channel 34 and ultrasonically welded to the perpendicularly extending posts. This assembly may, of course, be achieved in any suitable manner well known to those of ordinary skill in the art and may be fabricated in metal as well as plastic.

In sum, the inventors' novel contribution to the art provides a shaving system having peculiar advantages to the user, which system is designed to prevent inadvertent, unsafe and disadvantageous use while allowing for employment of the system cartridge with conventional handles.

What is claimed is:

1. A replaceable blade cartridge shaving system comprising:

an elongated handle member having a head portion extending transversely thereof, the head portion including a pair of longitudinally extending co-planar opposed flange members extending substantially perpendicular to the head portion and a substantially rigid protuberance member located medially of the flanges and extending a predetermined significant distance beyond the plane containing the flanges; and a replaceable blade cartridge having coupling structure defining two opposed spaced grooves adapted for longitudinal slidable engagement with the flange members for attaching the cartridge to the handle in a desired shaving position, and a clearance recess between the coupling grooves for accepting the protuberance member when the cartridge is slidingly coupled to the handle, said protuberance member having a particular geometry transversely of the longitudinal extent of said flange members, and the geometry of said clearance recess transversely of the longitudinal extent of said cartridge being sufficient to clear said protuberance member at least from one end of said cartridge continuously to a position enabling said attachment of said cartridge with said handle in said desired shaving position.

2. The system of claim 1 wherein the protuberance member is substantially co-extensive with the flange members.

3. The system of claim 2 wherein the flange members include a substantially "U" shaped member having side walls upstanding from a base portion affixed to the head and longitudinally co-extensive therewith, and the protuberance member extends medially of the side walls and is of substantially rectangular cross-section.

4. The system of claim 3 wherein the head terminates in a planar surface having at least one post member upstanding therefrom, the post member being in registration with and extending through a complementary aperture in the base portion and into a complementary recess in the protuberance member and is affixed thereto.

5. The system of claim 4 wherein there are two post members affixed to the base portion and protuberance member.

6. The system of claim 5 wherein the head and the protuberance member are made of plastic and ultrasonically welded together.

7. The system of claim 2 wherein the head, the protuberance member and the flange member are integrally molded of plastic material.

8. The system of claim 1 wherein the head has a trapezoidal cross-section and terminates in a planar surface forming the larger base thereof, and the flange member comprises a substantially "U" shaped member having side walls upstanding from a base portion in contact with the surface and with flanges extending outwardly normally of the side walls, and tang members extending from the base portion for affixing the flange member to the head when the tang members are bent into contact with longitudinal surfaces of the trapezoidal shaped terminal end.

9. The system of claim 8 wherein the side walls extend from the base portion toward the handle, and the protuberance member comprises the base portion with the flange member affixed thereto.

* * * * *